United States Patent [19]

Shifley

[11] Patent Number: 4,934,685

[45] Date of Patent: Jun. 19, 1990

[54] SHEET FEEDER FOR TWO STACKS OF SHEETS

[75] Inventor: James D. Shifley, Rochester, N.Y.

[73] Assignee: Eastman Kodak Company, Rochester, N.Y.

[21] Appl. No.: 737,960

[22] Filed: May 28, 1985

[51] Int. Cl.[5] ..... B65H 5/02

[52] U.S. Cl. ..... 271/35; 271/165

[58] Field of Search ..... 271/34, 35, 119, 120, 271/121, 122, 124, 125, 37, 38, 9, 165, 166

[56] References Cited

U.S. PATENT DOCUMENTS

| | | | |
|---|---|---|---|
| 2,273,288 | 2/1942 | Rouan | 271/35 |
| 2,635,874 | 4/1953 | La Bore | 271/35 |
| 3,239,213 | 3/1966 | Griswold | 271/35 |
| 3,288,461 | 11/1966 | Smith | 271/35 |
| 3,622,149 | 10/1969 | Enskat | 271/35 |
| 3,733,068 | 5/1973 | Herring et al. | 271/9 |
| 3,806,111 | 4/1974 | Lachman et al. | 270/54 |
| 3,963,339 | 6/1976 | Taylor et al. | 355/3 R |
| 4,084,805 | 4/1978 | Simpson | 271/4 |
| 4,085,929 | 4/1978 | Tuchiya et al. | 271/122 |
| 4,231,561 | 11/1980 | Kaneko et al. | 271/3.1 |
| 4,284,269 | 8/1981 | Ignatjev | 271/122 |
| 4,332,375 | 6/1982 | Tsubo | 271/9 |
| 4,333,640 | 6/1982 | Miller | 271/9 |
| 4,458,890 | 7/1984 | Kawazu | 271/37 |
| 4,544,147 | 10/1985 | Dinnissen | 271/122 |
| 4,548,395 | 10/1985 | Snellman et al. | 271/165 |

FOREIGN PATENT DOCUMENTS

| | | | |
|---|---|---|---|
| 2539902 | 3/1977 | Fed. Rep. of Germany . | |
| 0119640 | 9/1980 | Japan | 271/122 |
| 675911 | 7/1952 | United Kingdom . | |

OTHER PUBLICATIONS

Xerox Disclosure Journal, "Pneumatic (Angled Jets) Bottom Feeder" by Richard P. Schell, vol. 6, No. 5, Sep./Oct., 1981, p. 235.

*Primary Examiner*—Joseph J. Rolla
*Assistant Examiner*—Edward S. Ammeen
*Attorney, Agent, or Firm*—Lawrence P. Kessler

[57] ABSTRACT

Two stacks of sheets are supported by a tray, one stack resting directly on the tray and the other stack being on top of the first stack. The two stacks of sheets are separated by a stack separation roller that rests on the top of the first stack of sheets and is engageable by an edge of the second stack of sheets to thereby offset the stacks of sheets. Sheets are fed seriatim from the bottom of the first stack until all sheets of the first stack are removed. When the first stack of sheets has been fed from the tray, the separation roller is raised and the second stack of sheets is moved to the position previously occupied by the first stack. Then the second stack of sheets is fed seriatim from the tray.

8 Claims, 2 Drawing Sheets

SHEET FEEDER FOR TWO STACKS OF SHEETS

BACKGROUND OF THE INVENTION

It is known to provide a sheet feeder having a tray for receiving one stack of sheets and then to feed the sheets seriatim from the bottom of the stack. Feeders of this type have been used, for example, for feeding document sheets in an electrographic copier seriatim from a tray to a station where the sheets are illuminated for copying. The sheets in the stack represent a job to be copied. When the operator wishes to copy another stack of sheets comprising a second job, the operator waits until all sheets of the first stack have been fed from the tray before the tray is loaded with the second stack of sheets. Although this procedure works satisfactorily, it does require the operator to be at the copier when the first job has been fed from the tray in order to load the second job into the tray. Clearly it would be advantageous to allow two jobs to be fed sequentially by the sheet feeder and without the need for further operator intervention after the first job is completed. Such would reduce the time the operator is required to be at the copier and also increase the productivity of the copier by reducing the time when the copier is not operating.

SUMMARY OF THE INVENTION

It is an object of the present invention to provide a sheet feeder which permits two different stacks of documents to be loaded into the feeder and be fed sequentially from the feeder without operator intervention.

Another object of the invention is to provide a sheet feeder capable of maintaining separation of different jobs in the apparatus, and to such a feeder which allows a second job to be automatically fed after the first job without operator intervention.

In accordance with the present invention, a sheet feeder is provided for feeding sheets seriatim from first and second stacks of sheets supported by a tray. Initially the first stack of sheets rests on the tray and the second stack of sheets is on top of the first stack. The feeder includes a sheet feed member engageable with the bottom sheet in the tray for advancing the sheets seriatim from the tray along a sheet path. A stack separation roller is located above the tray and is mounted for movement toward and away from the tray. The separation roller is engageable with the top sheet in the first stack of sheets and is engageable by an edge of the second stack to offset such edge of the second stack from a corresponding edge of the first stack. The separation roller and the second stack move downwardly toward the tray as sheets are fed from the first stack by the sheet feed member. The separation roller is raised after the top sheet of the first stack has been fed from the tray. This permits the second stack of sheets to be fed seriatim along the sheet path by the sheet feed member.

BRIEF DESCRIPTION OF THE DRAWINGS

In the detailed description of the preferred embodiment of the invention presented below, reference is made to the accompanying drawings in which.

DETAILED DESCRIPTION OF A PREFERRED EMBODIMENT

Figure 1:
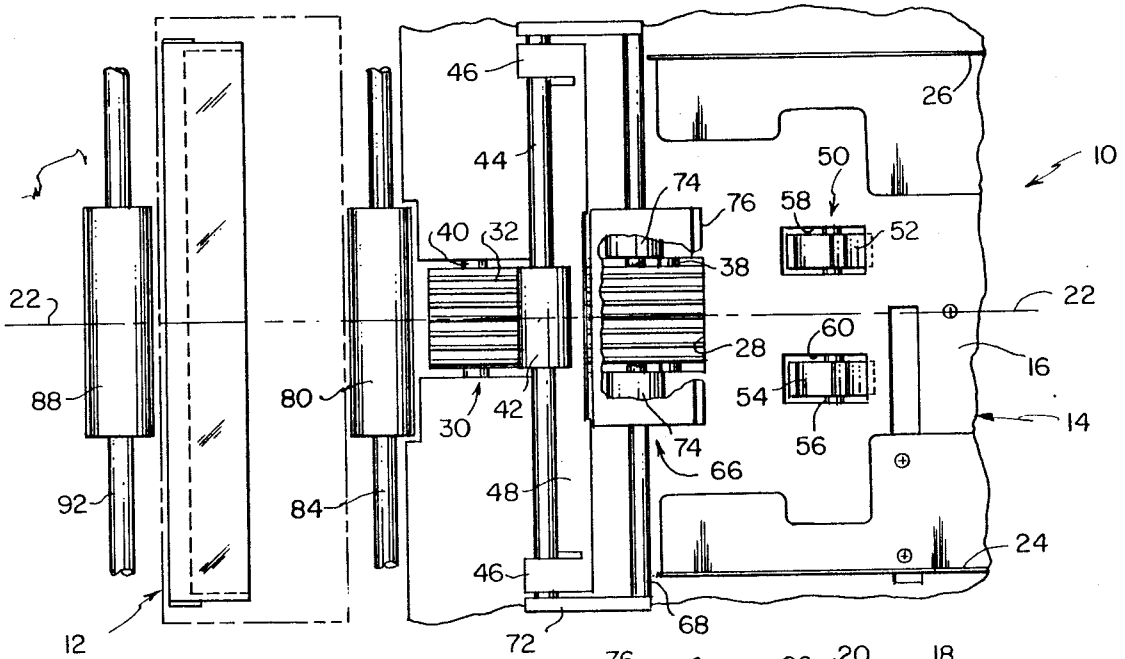
FIG. 1 is a plan view of a preferred embodiment of a sheet feeder of the present invention.
Figure 2:
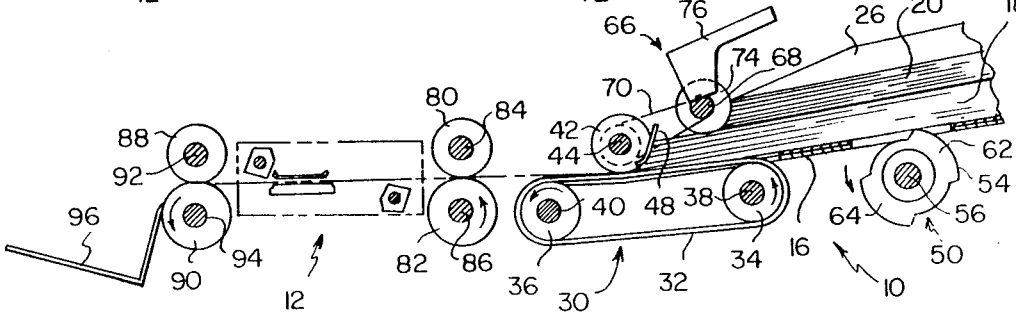
FIG. 2 is a cross section view through the feeder of FIG. 1 and showing two stacks of sheets in the feeder.

Referring now to FIGS. 1 and 2, a preferred embodiment of a sheet feeder of the present invention is generally designated 10 and, as illustrated in the drawings, can be used for feeding document sheets to a station 12 of an electrographic copier. At station 12 the sheets are illuminated and an image thereof is provided to a photoconductor of the copier for making copies in a manner known in the art.

Feeder 10 includes a tray generally designated 14 having a substantially flat bottom plate 16 for supporting a first stack of document sheets 18 comprising a first job to be run on the copier and a second stack of document sheets 20 comprising a second job to be run on the copier. The stacks of document sheets are preferably centered along a centerline 22 (FIG. 1) of the feeder. The document sheets can be located with respect to centerline 22 by a pair of adjustable side guides 24, 26 located at opposite side edge portions of the tray. The guides 24, 26 are substantially parallel to the centerline 22 and equally spaced from the centerline. Preferably the side guides are coupled for conjoint movement toward and away from the centerline in any suitable manner. Alternatively, indicia can be provided on the upper surface of plate 16 to facilitate centering of sheets on the plate.

An elongate opening 28 is provided in the left end portion of plate 16 and extends from the left edge of the plate along centerline 22 of the feeder. Opening 28 accommodates means generally designated 30 for feeding sheets seriatim from the tray. The preferred sheet feed means 30 illustrated in the drawings comprises an endless belt 32 trained about two spaced and parallel rollers 34, 36 mounted on shafts 38, 40, respectively. Rollers 34, 36 are located with respect to the bottom plate 16 of the tray so that the upper reach of the belt extends partly above the upper surface of plate 16. Thus document sheets 18 placed in the tray have at a least a portion thereof resting on the upper reach of the belt 32. When one of the rollers 34, 36 is driven to rotate the rollers in the direction indicated by the arrows in FIG. 2, the bottom sheet of a stack of sheets in the tray is urged to the left along a sheet path from tray 14 through station 12. Preferably the outer surface of the belt has relatively high friction characteristics to facilitate feeding of sheets from the stack. For example, the surface of the belt can be roughened, provided with grooves, etc, as well known in the art. In addition, while a friction or scuff belt is illustrated in the drawings, it will be understood that the belt 32 can be replaced with a vacuum belt feeder, an oscillating vacuum feeder or other known sheet feeding means.

A retard roller 42 is located immediately above the upper reach of belt 32 and between the side edges of the opening 28 in plate 16. Roller 42 is spaced slightly from the upper surface of belt 32 and can be driven in a direction opposite thereto. The purpose of the retard roller 42 is to ensure separation and feeding of only the lowermost sheet in a stack on the tray 14 by retarding advancement of other sheets in the stack. Roller 42 is mounted on a shaft 44 that is journaled in suitable supports 46 at side portions of the feeder.

A striker plate 48 extends across the feeder immediately above plate 16 of the tray and the upper reach of belt 32. The plate is located substantially aligned with the surface of roller 42 nearest the stack 18 of sheets on the tray and is perpendicular to centerline 22. The stack 18 of sheets has its forward edge positioned against the striker plate and the retard roller 42.

Belt 32 is normally effective to feed sheets from the bottom of a stack 18 of sheets. However, when the stack of sheets is especially heavy, either due to the number of sheets in the stack or the weight of paper comprising the sheets, or the combination thereof, belt 32 alone may not always be effective to reliably remove a sheet from the stack. Accordingly, a sheet feed assist mechanism 50 is preferably provided. Mechanism 50 comprises a pair of identical cam-shaped rollers 52, 54 mounted on a shaft 56 located beneath the plate 16 of the tray and to the right (upstream) of the belt 32. Openings 58, 60 are provided in plate 16 immediately above the rollers 52, 54. As shown in FIG. 2, roller 54 has a pair of diametrically opposed cam lobes 62, 64. At least the lobes of rollers 52, 54 are formed of a high friction material. Similar cam lobes are provided on the roller 52.

Figure 3:
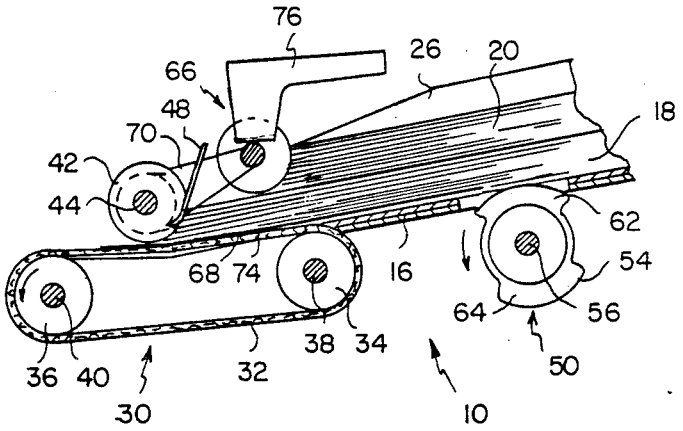
FIG. 3 is a detail view illustrating operation of the feed assist rollers.

Normally rollers 52, 54 are located in the position illustrated in FIG. 2 wherein the rollers are out of contact with sheets in the tray. However, when a sheet is to be fed from the tray, the rollers 52, 54 are rotated on a counterclockwise direction as viewed in FIGS. 2 and 3 through 180-degrees. Such rotation brings one of the cam lobes of each roller into engagement with the sheet resting directly on the plate 16 as shown in FIG. 3. As this occurs, the cam lobes exert an upward force on the entire stack of sheets 18 to thereby fluff and separate sheets of the stack. At the same time, the cam lobes exert a forward direction to the bottom sheet of the stack, thereby assisting belt 32 in feeding the bottommost sheet of the stack beneath the retard roller 42 and along the sheet path to station 12. The fluffing of the sheets reduces the sheet-to-sheet friction between sheets in the bottom of the stack and facilitates feeding of the sheets by the belt 32. After the rollers 52, 54 have rotated through 180-degrees, they stop and further feeding of the lowermost sheet is accomplished by belt 32 and without the feed assist mechanism 50. At this time, the cam lobes of rollers 52, 54 are out of contact with the bottom sheet in the tray so that they do not interfere with advancement of the sheet by belt 32.

A stack separation and normal force roller assembly is illustrated generally at 66. Assembly 66 comprises a shaft 68 journaled at its ends in supports 70, 72. The supports, in turn, pivot about the axis of shaft 44 so that the supports and thus the shaft 68 can be swung about the axis of shaft 44. Shaft 68 carries one or more rollers 74. Two rollers 74 are shown in the drawings on opposite sides of centerline 22. The rollers 74 are on opposite sides of opening 28 and drive belt 32. Assembly 66 can be raised for loading stacks of document sheets in the tray either by grasping the shaft 68 or by means of a handle 76 (FIG. 2) that straddles rollers 74 and is secured to the shaft 68.

When stacks of document sheets are to be placed in the tray 14, assembly 66 is raised by moving it in a counterclockwise direction from its FIG. 2 position to thereby allow the first stack of document sheets 18 to be positioned in the tray with the left edge of the stack in engagement with striker plate 48. Then the assembly 66 is swung in a clockwise direction until rollers 74 rest on top of stack 18, at which time the rollers are spaced from the striker plate 48. Then the stack of document sheets 20 is placed on top of stack 18 and with the left edge of stack 20 in abutment with the rollers 74 and offset from the corresponding edge of stack 18. Thus rollers 74 maintain separation between the first job to be copied comprising the stack of sheets 18 and the second job to be copied comprising the stack of sheets 20. Rollers 74 function somewhat like the retard roller 42. More specifically, rollers 74 present an abutment which restrains sheets of stack 20 from moving to the left until all sheets of stack 18 have been fed from the tray.

Sheets removed from tray 14 by belt 32 are driven off of the left end of the plate 16 and into the nip between a pair of rollers 80, 82 mounted on shafts 84, 86 respectively. Shaft 86 can be driven to advance the sheets into station 12 where they are illuminated for copying by the associated copier apparatus. Exposure can occur while the sheet is moving through station 12, or the sheet can remain stationary in station 12 and be exposed by flash illumination or by a scanning mechanism. Such modes of illumination are well known in the art.

When the sheets leave station 12, they enter the nip between a pair of rollers 88 and 90 mounted on shafts 92 and 94, respectively. One of these rollers is driven to thereby advance the sheets into an output tray 96. The sheets are received and stacked in tray 96 in the same orientation as when they were placed in the tray 14.

Operation of the sheet feeding apparatus of the present invention will now be described. Initially it will be assumed that the machine operator has two stacks of document sheets 18 and 20 representing two separate and distinct jobs that are to be run on the copier. The machine operator will grasp handle 76 and swing rollers 74 in a counterclockwise direction so that the stack of document sheets 18 can be placed on plate 16 and moved to the left into engagement with the striker plate 48. Then handle 76 is moved in a clockwise direction until the roller 74 rests on top of the uppermost sheet of stack 18. Then the stack of sheets 20 can be loaded by placing them on top of the stack 18 with the left edge of the stack 20 being in engagement with the roller 74. Loading of stack 20 can occur immediately after stack 18 is loaded and before feeding of sheets from stack 18 begins, or loading of stack 20 can occur at any time during feeding of sheets 18 from the stack.

When feeder 30 is operated, the first or lowermost sheet of the stack 18 is fed by driving belt 32 and, if desired, by rotating cams 52, 54 once through 180°. As shown in FIG. 3, rotation of cams 52, 54 drive the bottommost sheet of the stack forward or to the left and simultaneously fluff and separate the sheets at the lowermost part of the stack. At the same time, high friction belt 32 is driving against the lower surface of the lowermost sheet in stack 18. The combination of these forces drives the sheet from the bottom of the stack 18 across plate 16 of the tray and into the nip between rollers 80, 82. Rollers 80, 82 then drive the sheet into station 12 and subsequently feed the leading edge into the nip between rollers 88 and 90. The latter pair of rollers then advance the sheet into the output tray 96. At the appropriate time in the machine's cycle, cams 52, 54 are again rotated 180-degrees and belt 32 driven to advance the sheet then at the bottom of the stack 18 into the nip between rollers 80 and 82. This sequence is repeated until all sheets of stack 18 have been fed from tray 14.

Figure 4:
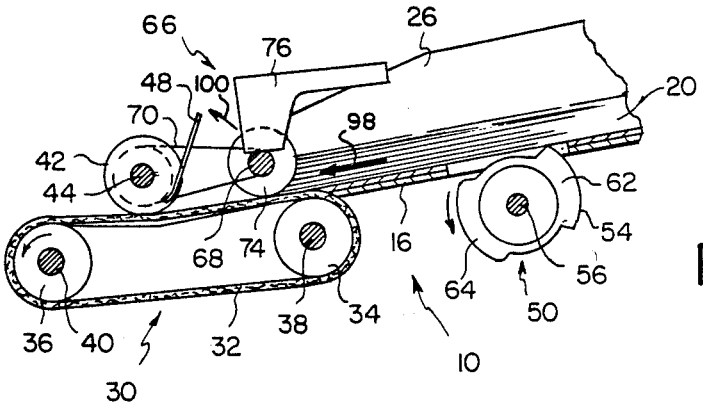
FIG. 4 is fragmentary view, similar to part of FIG. 2, but showing the feeder after the first stack of sheets has been removed from the tray.
Figure 5:
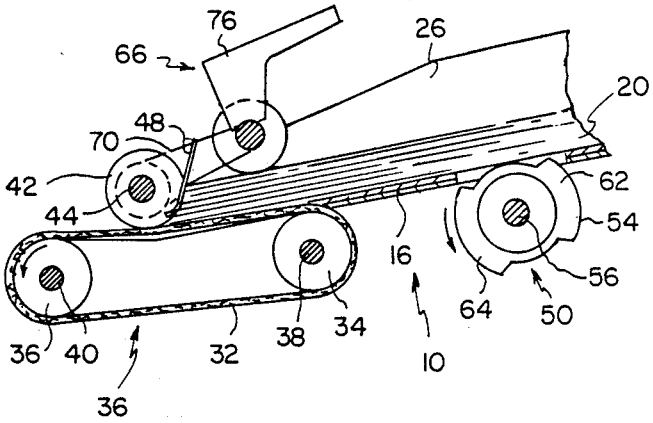
FIG. 5 is a view similar to FIG. 4 but illustrating the second stack of sheets in position for feeding.

When all sheets of stack 18 have been fed from tray 14, stack 20 rests on plate 16 of tray 14 as illustrated in FIG. 4. At this time cams 52, 54 are rotated to bring their respective cam lobes into engagement with the bottom of stack 20 of sheets one or more times, thereby producing a driving force urging the stack of sheets to the left and against rollers 74, such force being indicated by the arrow 98 in FIG. 4. Most of the force exerted by the cams will be on the lower portion of the stack 20 and beneath the axis of rollers 74. Thus, most of the force 98 is applied through a wedge-shaped contact area between rollers 74 and the leading edge of a few of the lower sheets in the stack 20. As a result, there is a force shown by arrow 100 urging the rollers 74 in an upwardly direction about the axis of shaft 44, thereby causing the roller to move upwardly and allowing the stack 20 to move to the left under rollers 74 until the left edge of stack 20 is in engagement with the striker plate 48 as shown in FIG. 5. At this time feeding of sheets from stack 20 can proceed in the manner described hereinbefore in connection with stack 18. The assembly 66 is relatively light in weight. In constructing the apparatus the relationship between the weight of assembly 66 and the magnitude of force 98 is adjusted so that the rollers 74 are swung upwardly in response to the force 98, as described hereinbefore.

As sheets are fed from stack 20, another stack of sheets (not shown) can be loaded for feeding to station 12 by placing the new stack directly on stack 20 and with the left edge thereof in engagement with roller 74. Thus the new stack of sheets will occupy the position shown for stack 20 in FIG. 2.

The invention has been described in connection with feeding of sheets to a station 12 of an electrographic copier where the sheets can be illuminated for making copies thereof. However, the sheet feeding apparatus can be used for feeding blank copy sheets in a copier or for other types of apparatus where advancement of sheets seriatim from the bottom of the stack is required and where it is desirable to be able to load a second stack of sheets before or during feeding of the first stack of sheets.

A number of advantages are achieved by the present invention. A second job is automatically started after the first job is completed without the need for an operator to be present to start the second job. Thus less operator time and attention is required. Also, the copier is more productive because there is very little delay between the first and second jobs.

The invention has been described in detail with particular reference to a preferred embodiment thereof, but it will be understood that variations and modifications can be effected within the spirit and scope of the invention as described here and above and as defined in the appended claims.

I claim:

1. A sheet feeder for feeding sheets seriatim from first and second stacks of sheets supported by a tray, the first stack of sheets resting on the tray and the second stack of sheets being on top of the first stack, the feeder comprising:

a sheet feed member engageable with the bottom sheet in the tray for advancing the sheets seriatim from the tray along a sheet path, means positioned relative to the tray for engagement by one edge of the first stack of sheets for locating the sheets in the tray in a position for feeding from the tray by the sheet feed member, a stack separation roller located above the tray and mounted for movement toward and away from the tray, the separation roller being engageable with the top sheet of the first stack of sheets and being engageable by an edge of the second stack to thereby offset and separate such edge of the second stack from the one edge of the first stack, the separation roller and the second stack being movable downwardly toward the tray as sheets are fed from the first stack by the sheet feed member until all sheets of the first stack have been fed from the tray to maintain the separation of the stacks, and means for raising the separation roller after the top sheet of the first stack has been fed from the tray, thereby permitting the second stack of sheets to be fed seriatim along the sheet path by the sheet feed member.

2. The sheet feeder as set forth in claim 1 wherein the engagement means comprises a striker plate and a retard roller located above the sheet feed member and the sheet path, the retard roller and the sheet feed member cooperating to feed one sheet at a time from the bottom of the stack.

3. The sheet feeder as set forth in claim 1, wherein the sheet feed member comprises an endless belt having an upper reach engageable with an end portion of the bottom sheet in the tray, and further comprising at least one feed assist member spaced from the belt and engageable with the bottom sheet to assist initial feeding of the bottom sheet along the sheet path.

4. The sheet feeder as set forth in claim 3 wherein the feed assist member comprises a cam-shaped roller having lobes engageable with the bottom sheet when the roller is rotated, the lobes being spaced from the bottom sheet except when the roller is rotated.

5. A sheet feeder for feeding sheets seriatim from first and second stacks of sheets supported by a tray, the first stack of sheets resting on the tray and the second stack of sheets being on top of the first stack, the feeder comprising:

a sheet feed member engageable with the bottom sheet in the tray for advancing the sheets seriatim from the tray along a sheet path, means for locating the first and second stacks of sheets in the tray in a position for feeding sheets from the tray, the sheet locating means including means for separating the stacks of sheets in an offset relationship and for maintaining the offset relationship while all sheets of the first stack are advanced from the tray by the sheet feed member, the separating means being movable with respect to the second stack to permit feeding of sheets from the second stack after all sheets of the first stack have been fed from the tray.

6. The sheet feeder as set forth in claim 5 wherein the separating means comprises a roller engageable with the top sheet of the first stack and engageable by an edge of the second stack when the roller is in engagement with the first stack to offset and separate the stacks of sheets, the means mounting the roller for movement toward and away from the tray so that the roller can move toward the tray as sheets are fed from the first stack and the roller can then be moved away from the tray to allow sheets of the second stack to be fed from the tray by the sheet feed member.

7. The sheet feeder as set forth in claim 6 further comprising means for urging the roller upwardly after the first stack has been fed from the tray to allow feeding of sheets from the second stack by the sheet feed member.

8. The sheet feeder as set forth in claim 6 further comprising means engageable with the second stack of sheets after the first stack has been removed from the tray for driving the second stack against the roller in a direction to urge the roller upwardly and allow feeding of sheets from the second stack by the sheet feed member.

* * * * *